US005291715A

United States Patent [19]

Basile

[11] Patent Number: 5,291,715

[45] Date of Patent: Mar. 8, 1994

[54] SUSPENSION DEVICE FOR CONCRETE REINFORCEMENTS

[76] Inventor: Frank M. Basile, 361 Prospect St., E. Longmeadow, Mass. 01028

[21] Appl. No.: 645,785

[22] Filed: Jan. 25, 1991

[51] Int. Cl.[5] ..... E04C 5/16

[52] U.S. Cl. ..... 52/687; 52/689

[58] Field of Search ..... 52/677-689

[56] References Cited

U.S. PATENT DOCUMENTS 3,745,737 7/1973 Keller et al. ..... 52/687

FOREIGN PATENT DOCUMENTS 244115 4/1963 Australia ..... 52/689

407773 11/1970 Australia ..... 52/686

*Primary Examiner*—Richard E. Chilcot, Jr.

*Attorney, Agent, or Firm*—Deborah A. Basile

[57] ABSTRACT

A unique suspension device adapted to all styles and sizes of welded wire mesh concrete reinforcement fabric. The device rigidly suspends all schedules of reinforcing fabric in a predetermined, fixed parallel position with respect to the horizontal plane to which concrete is poured to form flat concrete slabs. The suspension device consists of a thin-walled bushing or ring composed of polyvinylchloride incorporating slots or cavities radially positioned at right angles to each other on its circumferal cross-section to accept, secure, and lock the reinforcing material into place to provide the desired level of suspension. The device maintains stacking characteristics in order to allow multiple parallel reinforcing fabric layering for industrial, high-stressed applications.

1 Claim, 4 Drawing Sheets

SUSPENSION DEVICE FOR CONCRETE REINFORCEMENTS

Figure 1A:
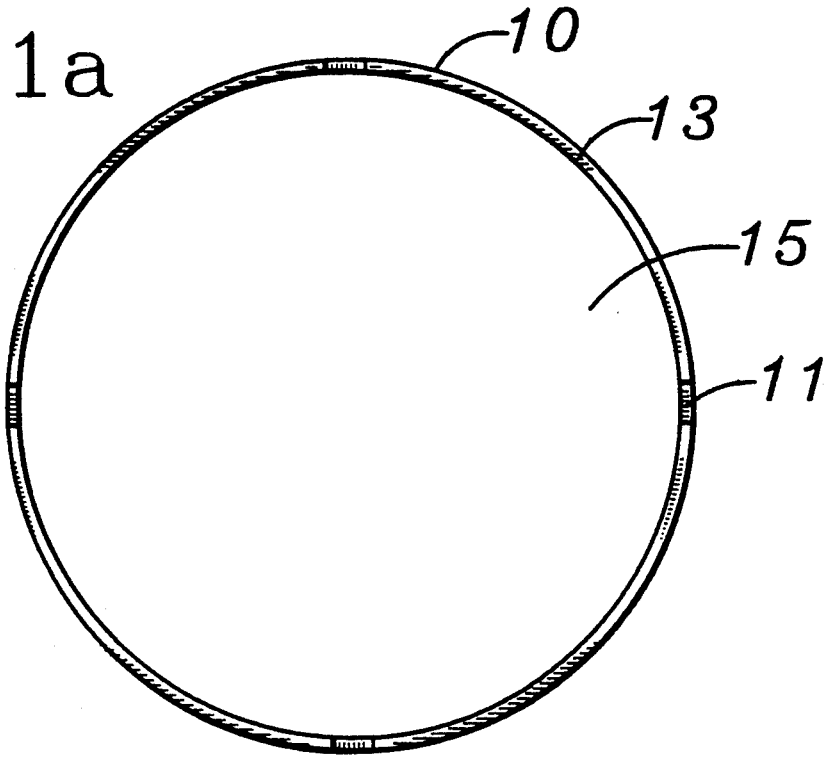

Proper positioning of reinforcing materials, e.g., wire mesh, rods, bars and the like in concrete pourings has been both theoretically and physically proven to be of utmost importance in concrete slab construction. Although that idea is well known and accepted, its implementation in the field is rarely carried out.

Regarding the pouring or forming of concrete slabs, the most readily used and prominent reinforcing material positioning techniques in the field today are very ineffective and can promote concrete disintegration rather than prevent it. One is the lifting procedure where the reinforcing material is positioned on the bottom surface of a horizontal form, and during the act of pouring the reinforcing material is lifted manually or with a tool to the supposed position. Another is by the use of a readily available solid object such as a brick to support the material. Although the latter most closely resembles the ultimate goal, it minimizes the strength of the concrete at the points of support.

The overall objective when reinforcing concrete is to place the reinforcement in the optimum location to provide the ultimate structural integrity to the end product. Concrete's physical properties possess phenomenal compression characteristics but drastically lack those in tension. Therefore, reinforcing materials with high-grade tension characteristics, preferably steel, are incorporated into the concrete during the pour, thus providing a structurally sound end product with inherently high quality tension and compression attributes.

The most detrimental among the many problems with regards to the lifting technique mentioned above is the likelihood that the steel reinforcing material will be dangerously close to any or all of the four outer surfaces of the pour. Most flat slab constructions are formed by erecting forms on a compacted inorganic earthen bed where moisture is prevalent. With concern to the steel reinforcing material positioned improperly within the concrete, a cracking situation becomes unavoidable due to moisture permeating the concrete or attacking surface steel and rusting. Rusting, being an expansion process, will cause the slab to crack.

Although, due to the following factors, there are several types of proposed spacing elements for supporting and retaining concrete reinforcing materials that have been utilized in the past but deemed ineffective. Most are constructed of metal; generally, steel or iron thereby susceptible to rusting/expansion problems. The few that are non-rustable, are viewed as too complex, and not adaptable to a variety of applications, and require special skills and/or tools to install.

Consequently, it is apparent, that there is a profound need, in the art of concrete construction for simple, adaptable, proven and cost-effective suspension devices for the foregoing and additional uses. It is the primary objective of this invention to provide such a versatile reinforcement suspension device to maximize the excellent durability and strength potential of concrete.

Specifically, this object is to provide a new and novel suspension device particularly adaptable for use in horizontal, vertical, diagonal and specific irregular slab constructions.

In addition, this object is to provide a unique reinforcement suspension device that will not tarnish, rust or self-destruct in order to preserve appearance and integrity of the concrete slab.

A more specific object is to provide a reinforcement suspension device as described which can be easily constructed by extrusion and injection molding or a product thereof, and be specifically adaptable for use with reinforcing wire fabrics, reinforcing bars, rods and the like.

Another, and solely original object, is its ability to be coupled with another suspension device of the same nature to maintain stacking characteristics in order to provide multiple parallel horizontal, vertical or diagonal reinforcing material, e.g., wire mesh, rod or bar, layering for industrial high stressed applications.

These objects and others are achieved in accordance with this specialized invention defined as a suspension device or support, comprising of a hollow cylindrical ring incorporating slots or cavities radially positioned on its circumferal cross-section thereby enabling the reinforcing material to become firmly secured and locked into the desired position. The device is composed of polyvinylchloride thereby yielding sound stability and durability before, during and after the concrete pour.

Four notches, at right angles to one another, on the top surface of the device are preferably adapted to the various types of reinforcing material whether it be mesh, rod, or bar and are designed to accept and grasp the specific type of reinforcement in a quick and efficient manner. The device's cylindrical shape affords itself with excellent ground stability while providing a minimal surface area, and a maximum amount of space allocated for the concrete. In addition to this device's primary purpose of reinforcement suspension, its rigid, strong, thermally stable, non-rustable construction constitutes an excellent reinforcing material in itself. Therefore, if used as recommended, it will supplement the primary reinforcing method and act as a perpendicular structural member to the reinforcing material, providing a secondary transverse strengthener to the completed concrete casting.

In addition to the above-mentioned slots, vertical, diagonal and some specific irregular slabs warrant the provided positive locking cavity. This cavity incorporated into 2, out of the 4, opposing slots acts as a one-way check valve for locking and positively securing the device to the reinforcing material. This advantage enables the devices to be pre-installed on the reinforcing material before it is placed into the forms.

These and other features and advantages will be better understood by referring to the following detailed description and to the accompanying drawings to which reference is made.

Figure 1B:
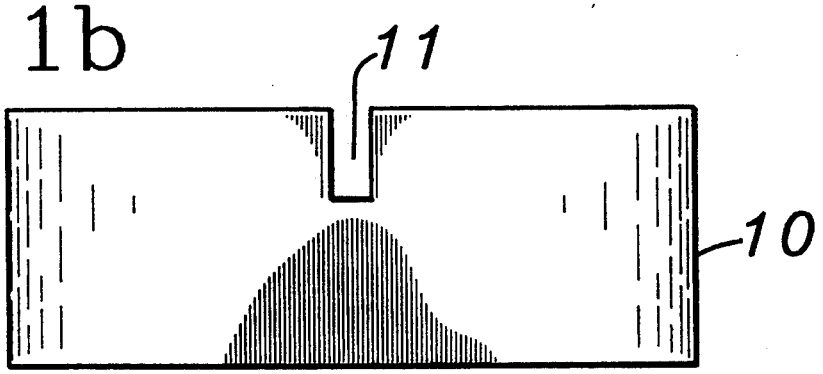
Figure 2A:
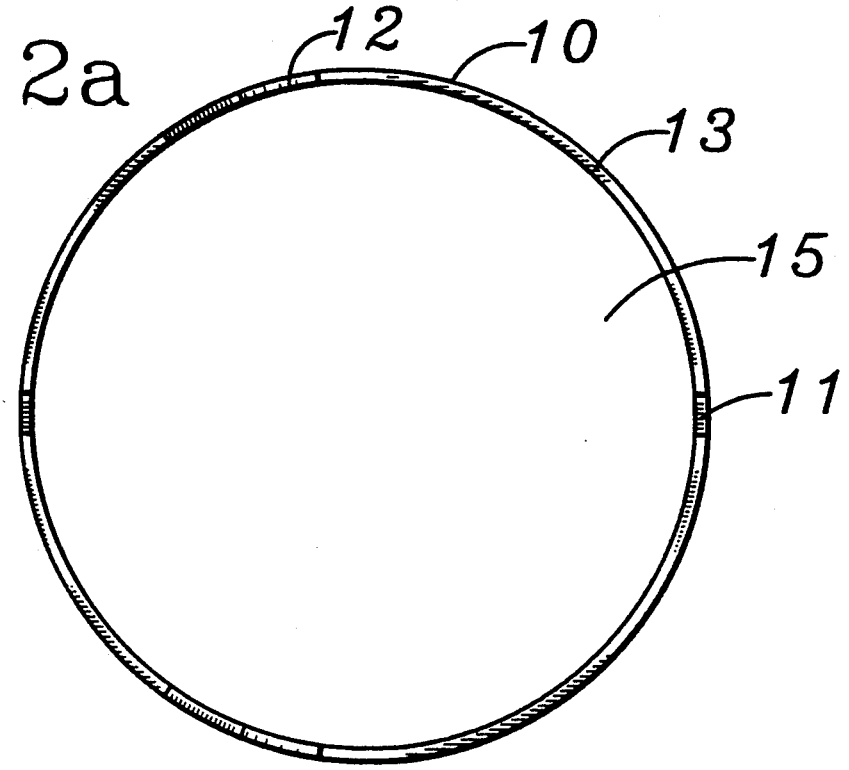
Figure 2B:
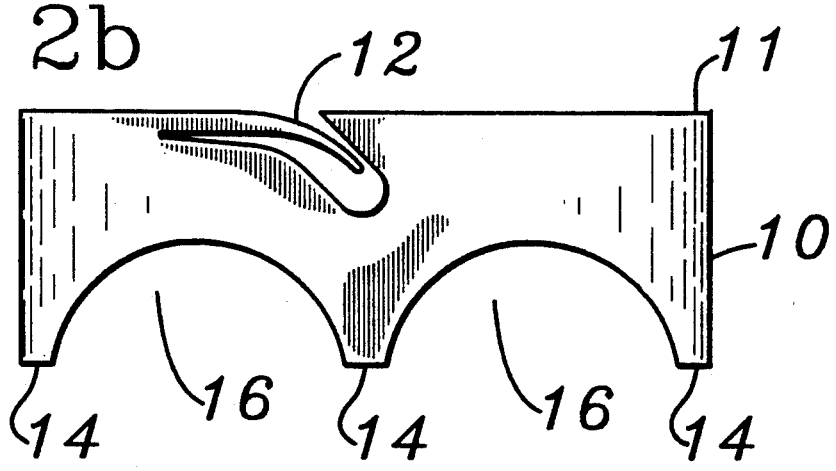
Figure 3A:
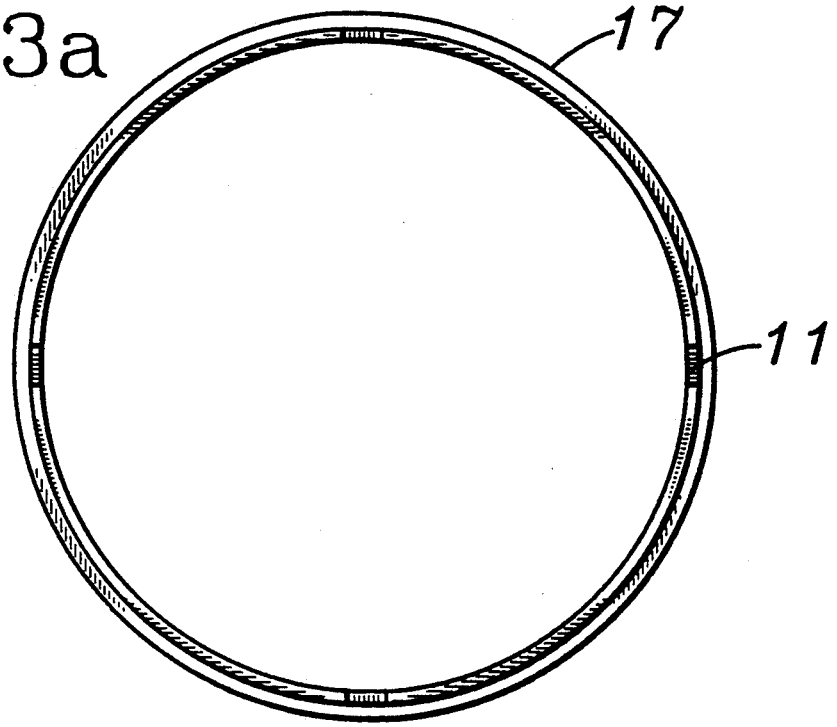
Figure 3B:
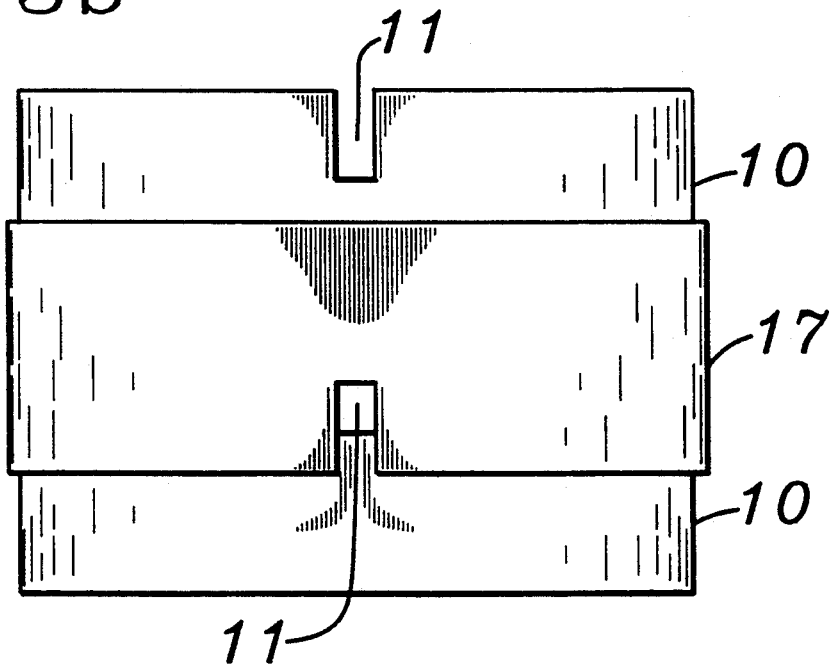
Figure 4:
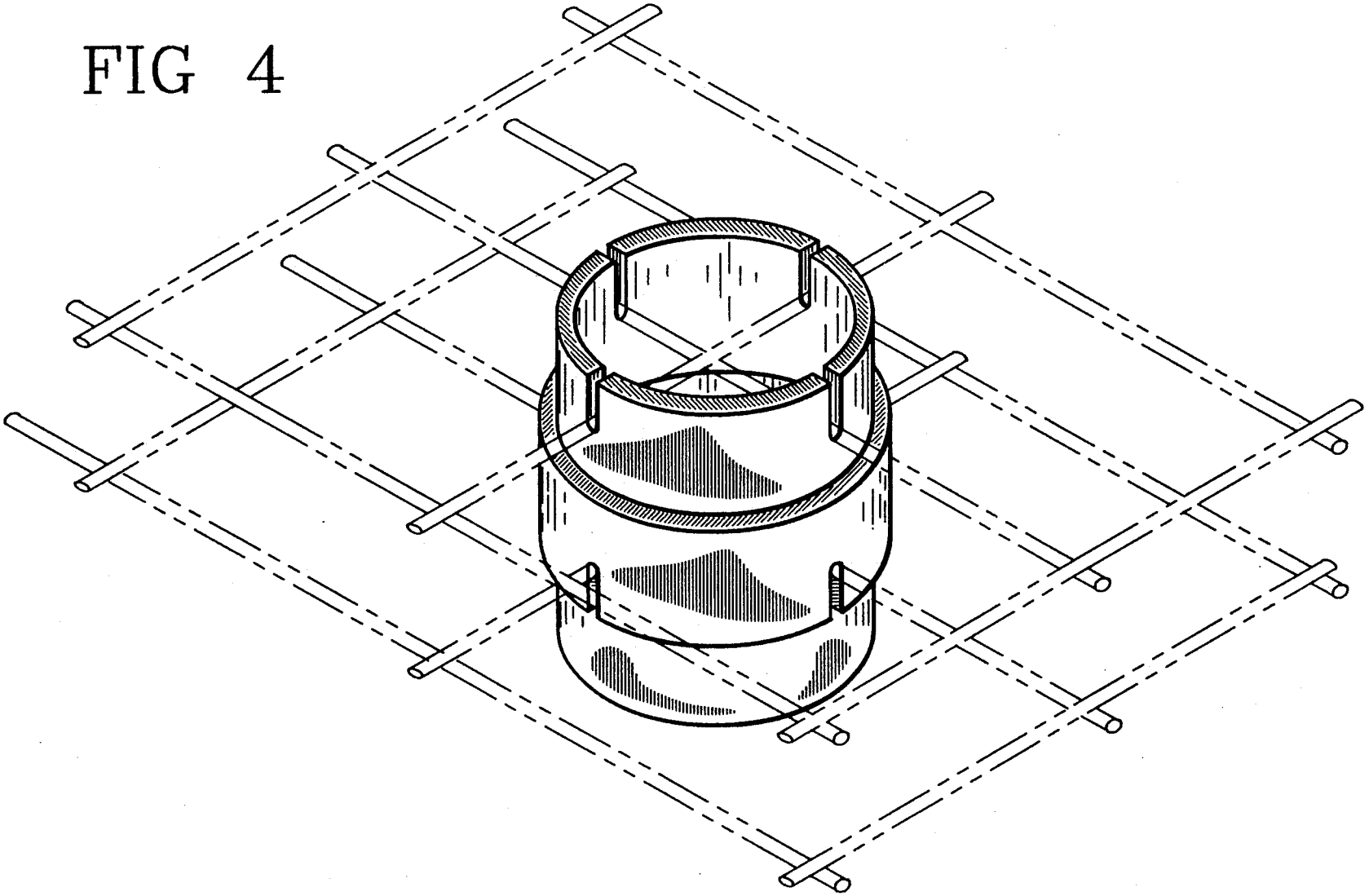

Referring to the Drawings:

FIG. 1*a*—Depicts a top view of the preferred type suspension device;

FIG. 1*b*—Depicts a frontal or side view of the said device;

FIG. 2*a*—Depicts a top view of the preferred type suspension device incorporating the positive locking cavity, limited surface contact base and arched concrete ports;

FIG. 2*b*—Depicts a frontal or side view of the said device incorporating the positive locking cavity, limited surface contact base and arched concrete ports;

FIG. 3*a*—Depicts a top view of the preferred type suspension device's stacking characteristics;

FIG. 3*b*—Depicts a frontal or side view of the said device's stacking characteristics; FIG. 4—Depicts the suspension device in a double parallel mode, another preferred use of the suspension device for positioning multiple layers of wire mesh at the desired locations.

Referring to FIGS. 1 and 2, shown is the preferred type reinforcing material suspension device 10 comprising of a hollow cylindrical thin-walled ring incorporating fastening slots 11 and/or positive locking cavities 12. The top surface 13 consumes a minimal surface area while providing excellent support not only for the reinforcing material, but also for the horizontal flat slab construction worker. While pouring, the concrete workers can utilize the device as a standing or footing aid in order to avoid stepping on the reinforcing material and possibly stumbling. Specifically considering FIG. 2*b*, the lower portion of this specialized suspension device incorporates the limited surface contact base 14, which minimizes the possible visible spots or marks which may appear on one side of a finished precast slab if it is so desired to expose that particular side. As a secondary purpose, the limited surface contact provision helps the liquid concrete completely fill the device's hollow central void 15 by utilizing the arched concrete ports 16 primarily effective in vertical or diagonal applications.

FIGS. 3 and 4 depict one of the key and most prominent advantages over all other methods of suspension. This unique feature is the device's ability to be coupled with another such device, through the use of a slightly oversized similar device 17 acting as a coupling. This similar object can also be used alone as a single reinforcement suspension device due to its equitable attributes to that of the preferred suspension device 10. This original provision enables the device to maintain stacking characteristics in order to provide multiple parallel horizontal, vertical, diagonal and specific irregular reinforcing material layering for industrial high stressed applications. Due to the close tolerance slip-fit connection between the preferred suspension device and the similar coupling device, a solid, secure fixture is constructed. This provision accommodates as many layers as desired and can be assembled using the regular preferred reinforcement suspension device with or without positive locking cavities limited surface contact base and arched concrete ports.

It is apparent that subtle changes, such as absolute or relative dimensions of the parts, materials and the like, can be implemented without departing from the spirit and scope of the invention.

As explained, it is apparent that the suspension device can be utilized in a variety of ways, and in such a manner as to provide substantial advantages over all other types of reinforcement material suspension objects or techniques presently performing or being performed in the field today. Considering vertical or diagonal poured-in-place wall formations, the suspension device with positive locking cavities, limited surface contact and concrete ports can be installed onto the reinforcing material outside of the form. The entire reinforcing material including the suspension devices can be lowered down in one piece within the form. In descending between a pair of walls, due to their inherent, highly adaptable features, the suspension devices do not rotate, become dislocated, or fall off.

It is no longer necessary to pre-cast work, to hand wire or suspend the reinforcing fabric, and consume copious amounts of time and energy in raising and tying the wire fabric at predetermined spaced intervals, to avoid its lying at the bottom of the casting. The suspension devices can be used to hold the reinforcements at the proper distances from the form or one another, at the proper positions desired. Now, utilizing the preferred device, the tops of pre-cast slabs can be easily finished because hanging rusty suspension wires are eliminated, therefore there is no surface interference and any method of concrete surface finishing can be performed.

Having defined the invention and its many rewarding features, what is claimed is:

1. A suspension device to hold welded wire fabric within a poured concrete slab said suspension device comprising a non-malleable cylindrical ring having a top surface and a bottom surface of equal diameter and a coupling device of the same characteristics and composition as said suspension device but having a diameter slightly larger than said suspension device and having a top surface and a bottom surface of equal diameter, wherein one of said suspension devices is received through the top surface of said coupling device and another of said suspension devices is received through the bottom surface of said suspension device such that said suspension devices and coupling devices facilitate unlimited stacking and layering of welded wire fabric.

* * * * *